US008843305B1

(12) United States Patent
Jacob

(10) Patent No.: US 8,843,305 B1
(45) Date of Patent: Sep. 23, 2014

(54) GEOGRAPHIC POSITION ENABLED WEAPONS LAUNCH SAFETY SYSTEM AND METHOD

(71) Applicant: Robert Jacob, Lusby, MD (US)

(72) Inventor: Robert Jacob, Lusby, MD (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 13/870,488

(22) Filed: Apr. 25, 2013

(51) Int. Cl.
*F42C 15/40* (2006.01)
*G06F 19/00* (2011.01)
*F42C 15/00* (2006.01)

(52) U.S. Cl.
CPC ..... *F42C 15/00* (2013.01); *F42C 15/40* (2013.01)
USPC ..... 701/408; 235/400

(58) Field of Classification Search
None
See application file for complete search history.

(56) References Cited

U.S. PATENT DOCUMENTS

| | | | | |
|---|---|---|---|---|
| 5,036,465 | A * | 7/1991 | Ackerman et al. | 235/400 |
| 7,127,334 | B2 * | 10/2006 | Frink | 701/3 |
| 2011/0089237 | A1 * | 4/2011 | Morocz | 235/400 |
| 2013/0218372 | A1 * | 8/2013 | Wolfanger et al. | 701/3 |

FOREIGN PATENT DOCUMENTS

EP 0878686 A2 * 11/1998

* cited by examiner

*Primary Examiner* — Michael J Zanelli
(74) *Attorney, Agent, or Firm* — Charles D. Buskey; NAWCAD

(57) ABSTRACT

A system and method for providing independent weapon launch or release control for an unmanned or autonomous vehicle by ensuring the vehicle is within its weapon launch area using geographic position information from a navigational source such as GPS, comparing the position of the vehicle to the weapon's launch boundaries, and arming or disarming the vehicle's weapon launch capability based on its location relative to the weapon launch area.

16 Claims, 3 Drawing Sheets

GEOGRAPHIC POSITION ENABLED WEAPONS LAUNCH SAFETY SYSTEM AND METHOD

STATEMENT OF GOVERNMENT INTEREST

The invention described herein may be manufactured and used by or for the Government of the United States of America for governmental purposes without payment of any royalties thereon or therefor.

BACKGROUND

The present invention relates to a geographic position enabled weapon launcher safety system and method intended for armed unmanned vehicles.

Inadvertent discharge or launch of a weapon is a significant hazard. The risk of this hazard is reduced by a variety of means in existing weapon systems. In firearms, a mechanical safety switch helps prevent inadvertent discharge of the weapon due to mechanical failures or handling errors. In armed manned vehicles such as ships, some ground vehicles, and aircraft, weapons release or launch authority can be controlled by an electrical circuit.

One method of providing control of launch or release authority (i.e. "enabling") to the weapon system on manned vehicles is through the use of a "Master Arm" switch controlled by a vehicle crewmember. In this situation, the crewmember determines if and when the vehicle is in a weapon launch area and manually enables the weapon system for weapons launch or release.

For tele-operated unmanned vehicles, there is no crewmember on board to enable the weapon launch or release authority of the weapons management system, so this safety function is dependent on the integrity of the link between the ground station and the vehicles communications system, as well as the reliability and maturity of the unmanned vehicle's stores management system.

Some unmanned vehicles are fully autonomous, meaning there is no human "in the loop." In other words, there is no pilot or operator on board and there is no human operating the vehicle remotely. The vehicle may be designed to "think for itself" in that it determines its own flight path, weapons arm and release decisions. With a human not in the loop as an independent safety control to verify launch criteria, the risk to life and property of an unsafe weapon launch or release may be unacceptable.

In addition, when new, unproven armed unmanned vehicles are being tested during their development, they may have unknown flaws or unexpected performance deficiencies which may increase risk to life and property with an inadvertent or uncontrolled weapons launch.

Operator training exercises also involve an increased level of risk due to an increased frequency of errors on the part of trainees. Erroneous control input to tele-operated vehicles or incorrect tasking inputs to autonomous vehicles have the potential to result in inadvertent or uncontrolled weapons launch.

For the foregoing reasons, there is a need for a system to enhance the safety of armed unmanned vehicles and prevent inadvertent weapon launch outside of acceptable geographic weapon launch boundaries.

SUMMARY

The present invention is directed to a geographic position enabled weapon launcher safety system and method for unmanned or autonomous vehicles. The system includes a navigation position source (typically but not limited to a Global Positioning System receiver or inertial navigation system), an external interface, a system mode controller, a memory, an arm power interrupt and a processor. The proposed invention controls the vehicle's weapon system launcher's electrical power between the vehicle stores management system and the vehicle weapon launcher.

The general approach to reducing the risk of inadvertent weapon launch or release in unmanned test vehicles on test ranges is to add an independent radio receiver and onboard test safety switch to provide additional redundant control to the stores management system (SMS) to allow for unexpected communications or SMS failure. This onboard safety switch is remotely operated by test personnel monitoring vehicle parameters. This method works well for tests of single vehicles but will not work well for simultaneous test or training events of multiple vehicles or situations requiring long duration continuous monitoring. The geographic position enabled weapon launcher safety system of the present invention is independent of the vehicle's ground station and communications link, and its reliability is established separately from the unmanned vehicle's systems.

The geographic position enabled weapon launcher safety system of the present invention provides an equivalent "master arm" function which is automatically activated when the vehicle's position is compared to stored boundary coordinates and found to be within the weapon launch boundary area. Consequently, this additional independent control ensures that weapons can only be launched or released in a pre-approved weapons launch or release area, thus reducing the risk of inadvertent launch.

DRAWINGS

The features, aspects and advantages of the present invention are shown with reference to the following description, appended claims, and accompanying drawings wherein:

DESCRIPTION

In the following description of the present invention, reference will be made to various embodiments which are not meant to be all inclusive. The current invention can be implemented using various forms of hardware and software in a variety of manned, unmanned or autonomous vehicles including aircraft, land vehicles and watercraft.

Figure 1:
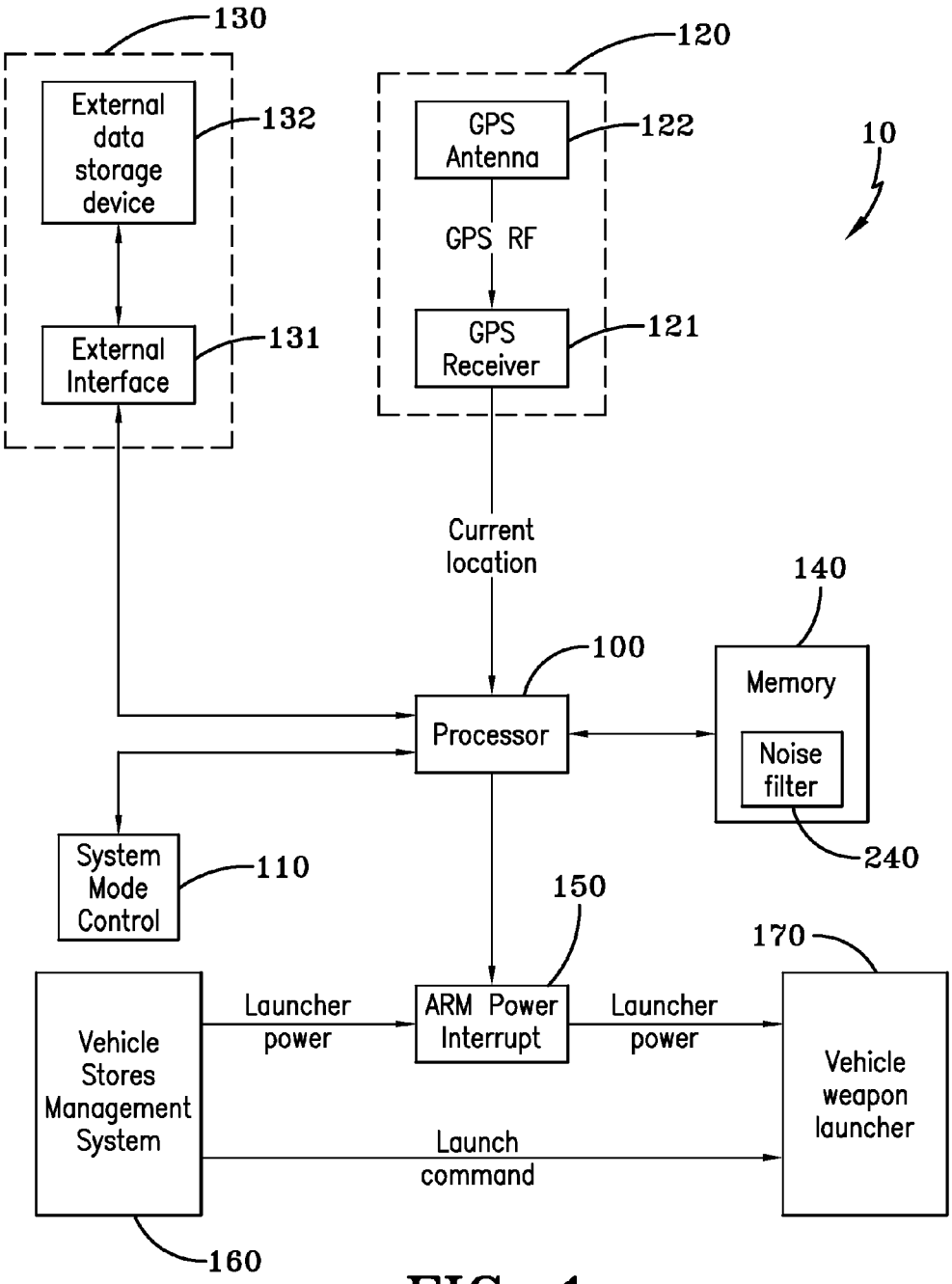
FIG. 1 is a block diagram of a component embodiment of the geographic position enabled weapons launch safety system.

The preferred embodiments of the present invention are illustrated by way of example below and in FIGS. 1-3. With reference to FIG. 1, the geographic position enabled weapons launch safety system [10] for unmanned or autonomous vehicles includes a processor [100], an external data input device [130] comprising an external interface [131] an external data storage device [132], a memory [140], a system mode controller [110], an arm power interrupt [150] and a navigation position source (typically but not limited to a Global Positioning System receiver or inertial navigation system) [120] which in the case of GPS would be comprised of an antenna [122] and a receiver [121]. The invention controls the power between the vehicle's stores management system [160] and weapon launcher [170], which are not part of the invention but are standard components in vehicle weapon launcher systems.

The arm power interrupt [150] is a device that enables or disables launch power from the vehicle stores management system [160] to the vehicle weapon launcher [170]. Typically, a pilot or crewmember in the vehicle or tele-operator from a remote location enables "Master Arm" allowing launch power from vehicle stores management system [160] to the vehicle weapon launcher [170].

In this invention, the function of the arm power interrupt [150] is controlled entirely by geographic position information. Geographic launch boundary information is received by the launch safety system through the external data input device [130]. The launch boundary information from the external data input device [130] is written to the system memory [140] where it is stored. As the vehicle moves through space (air, water or ground), the navigation position source [120] provides the coordinates of the vehicle which are sent to the system processor [100] where they are constantly compared to the launch boundaries stored in the memory [140]. When the vehicle is within launch boundary, an asynchronous hardware interrupt is initiated. That is, an alerting signal is sent to the processor [100] to disable the arm power interrupt [150] and allow launch power from the vehicle stores management system [160] to the vehicle weapon launcher [170]. Consequently, the vehicle can be armed for weapons launch only when it is physically within a defined launch boundary area.

In a preferred embodiment, the external data input device [130] is a data transfer device such as a universal serial bus (USB) flash drive, but it may also be an operator keyboard, radio receiver or other common input/output device as used in other applications. The external data input device [130] is used to write the geographic boundary definition to the system memory [140] and record verification data. The memory [140] retains the uploaded geographic boundary coordinates during operation and after the external storage data device is removed.

The navigation position source[120], which could be made of components such as a GPS receiver [121] and a GPS antenna [122], collects the current vehicle position information and transmits it to the processor [100] where it is then compared to launch boundary coordinates stored in the memory [140] to determine whether the craft is within the launch boundary. In a preferred embodiment of the present invention, navigation position source [120] is included as part of the launch safety system [10]. However, this system application may use an input from the vehicle's own navigation position source as a vehicle position reference. The GPS device shown in FIG. 1 can be any navigation position device for the purpose of determining the vehicle's geographic location.

Most armed vehicles will have some form of stores management system [160] and a weapon launcher [170]. The stores management system [160] provides the interface between an aircraft and its carriage stores, which may include weapons, pods, external fuel tanks, and the like. The stores management system defines the electrical characteristics of the connector and pin assignments used for the carriage stores and allows for a reliable release of the stores. While the stores management system [160] and weapon launcher [170] will be referenced for explanation, they are not required for this invention.

To launch a weapon, two signals are typically required: First power has to be applied to the vehicle weapon launcher [170], and then a launch command has to be given. The arm power interrupt [150] controls power to the vehicle weapon launcher [170]. For safety purposes, the default mode of the arm power interrupt [150] is an open circuit (i.e. power disabled). For the current invention, during vehicle operation, the processor [100] continuously compares the vehicle position, as determined by the navigation position source, [120] to the launch location boundaries stored in the memory [140]. If the vehicle is within an area defined by the launch boundaries, the processor [100] sends a command to the arm power interrupt [150] to allow launch power to the vehicle weapon launcher [170].

Figure 2:
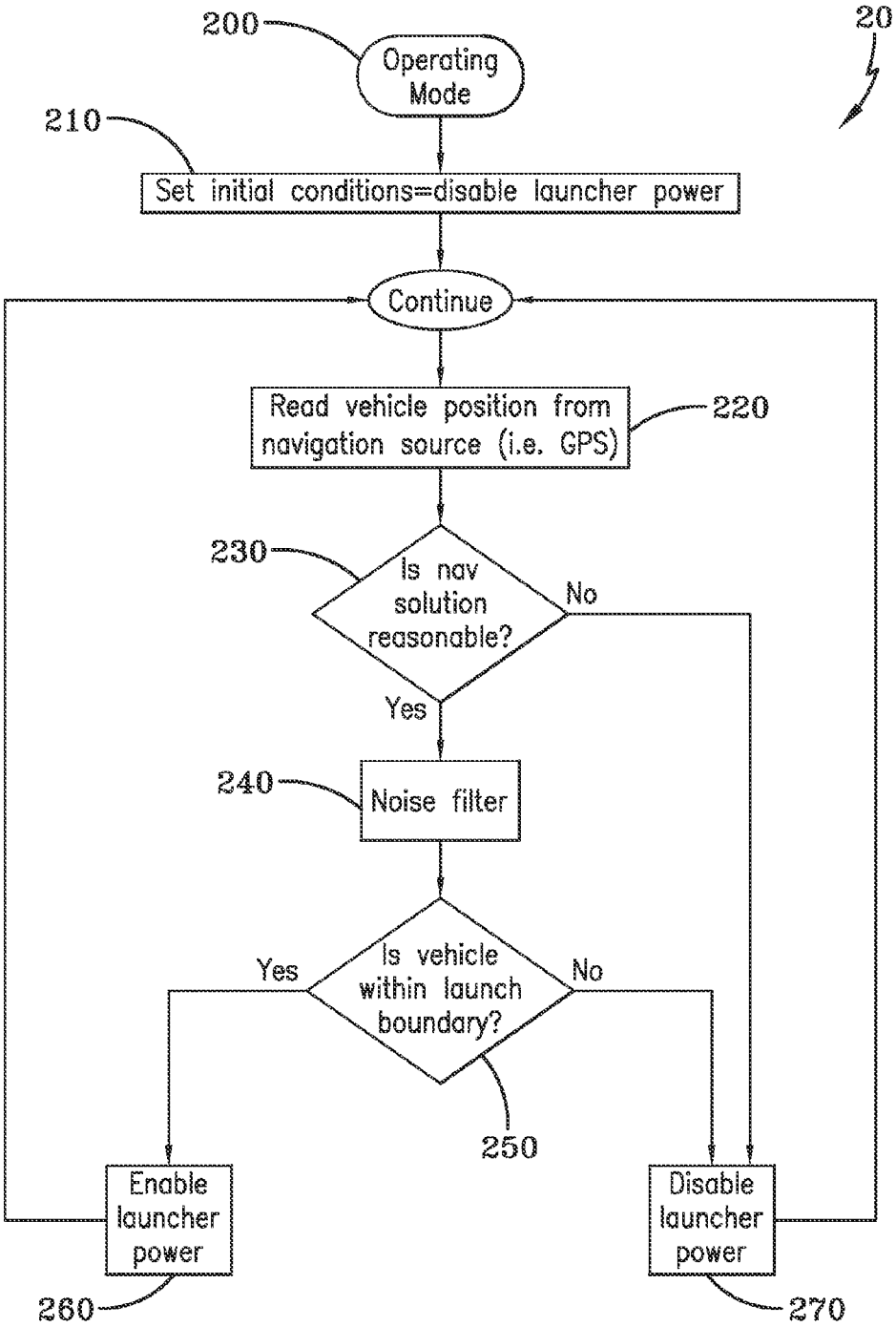
FIG. 2 is a flow chart showing an operational mode for the geographic position enabled weapons launch safety system.

Reference is now made to FIGS. 1 and 2. FIG. 2 shows a flow chart [20] of the operation of the geographic position enabled launch safety system. System operation begins when the system mode controller [110] switches the system operation mode [200] to "on," or a powered state. The launch safety system generally has three modes: "on.", "off," and "standby." The system mode controller [110] switches the launch safety system between these three modes. "On" mode represents a powered state, while "off" mode represents an unpowered state. In "standby" mode, power is available to the safety system and the system mode controller can be used to control transfer of geographic launch boundary information from the external data input device [130] to the system memory [140]. In "standby" mode the system mode controller [110] can also be used to control transfer of existing geographic and topographical boundary information from the system memory [140] to the external data input device [130]. In "standby" mode, the system mode controller [110] can also be used for maintenance checks of the 'arm power interrupt' [150] or stores management system [160] and weapon launcher [170] by manually enabling and disabling launcher power. Once the system mode controller is in the "on" or operational position, initial conditions are set [210] and maintenance and external read/write functions are no longer available. Initially, the vehicle weapon launcher [170] is set to a safe state by disabling the arm power interrupt [150].

In the next step [220], the vehicle position is read from the navigation position source [120]. Then, a navigation reasonability check [230] is performed to determine the accuracy of the position coordinates or boundary. The reasonability check [230] can be based on horizontal and vertical estimates or readings received from multiple sources. If it is determined that the reasonability check [230] is not accurate enough to determine if the vehicle is inside the safe launch area, the arm power interrupt [150] is disabled and no launch power can be sent to the vehicle weapon launcher [170].

In step [240], another preferred embodiment is incorporated into the system. A noise filter [240] is used to prevent the system from rapidly changing arming states as the vehicle traverses the boarders of launch zones. Geographic position system measurements may have a nominal degree of uncertainty and, oftentimes, a vehicle or craft may be on the edge of a boundary or launch zone where weapon launch is permitted. The noise filter [240], which is implemented in software, builds threshold tolerance distances into the system [10] to account for the fluctuations cause by traversing launch zone boundaries. If the vehicle has not significantly moved from the allowed tolerance distances the weapons launch safety system stays in its current state.

Next, in step [250] the launch safety system determines whether the vehicle is within the launch boundary. The system compares the vehicle position from the navigation position source [120] to acceptable launch locations stored in memory [140]. If the vehicle is inside the pre-defined boundaries of the launch locations and within the allowed tolerance distance of the noise filter (240), power to the vehicle weapon launcher [170] is enabled [260]. If the vehicle is outside of the predefined launch locations, power to the vehicle weapon launcher [170] is disabled [270].

Figure 3:
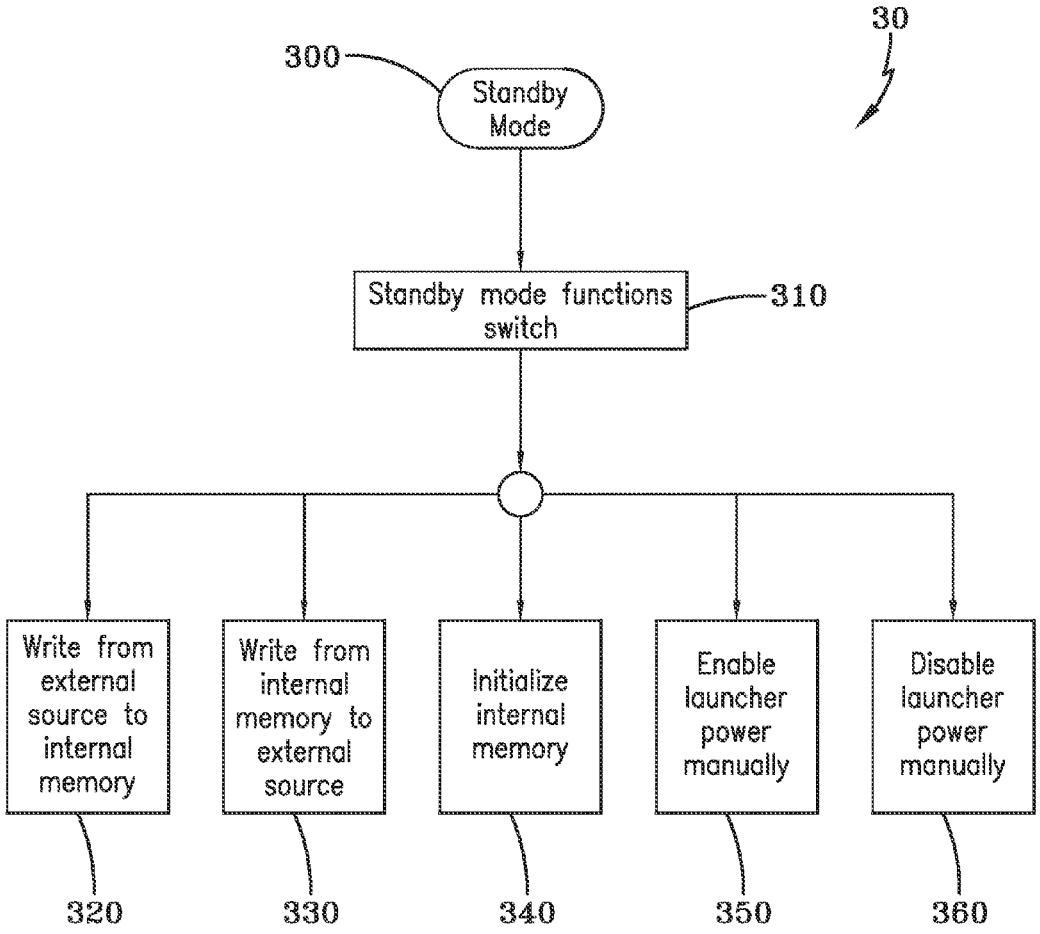
FIG. 3 is a flow chart showing the operation of the standby mode of geographic position enabled weapons launch safety system.

Reference is now made to FIGS. 1 and 3. FIG. 3 is a flow chart [30] describing the standby mode of the GPS enabled weapons launch safety system. The system mode controller is used to place the system in either on, off, or standby modes. In standby mode [300] power is available to the system and additional functions are available via the system mode controller [110]. Once the system is in standby mode [300], a standby mode functions switch [310] can be used to initiate various functions. One function [320] is to control transfer of information from the external data input device [130] to the system memory [140]. An example of this function is the controlled transfer of geographic launch boundary information from the external data input device [130] to the system memory [140].

Another function in standby mode [330] is to control transfer of information from the internal memory [140] to an external source [130]. An example of this function is the transfer of geographic launch boundary information from the internal memory [140] to an external source [130]. In addition, the internal memory can cleared [340].

Also, in standby mode [300], maintenance checks of the 'arm power interrupt' [150] or stores management system [160] and weapon launcher [170] can be performed by manually enabling [350] or disabling [360] the power to the vehicle weapon launcher [170].

Although the invention has been described in detail with particular reference to these preferred embodiments, other embodiments can achieve the same results. Variations and modifications of the present invention will be obvious to those skilled in the art and it is the intent of this application to cover, in the appended claims, all such modification and equivalents. The entire disclosure and all references, applications, patents and publications cited above are hereby incorporated by reference.

What is claimed is:

1. A vehicle weapon launcher safety system, comprising:

a processor;

a navigation position source in electronic communication with the processor;

an external interface in electronic communication with the processor;

a memory in electronic communication with the processor;

a system mode controller in electronic communication with the processor;

an arm power interrupt in electronic communication with the processor; and a noise filter residing in the memory;

wherein the processor controls operation of the arm power interrupt based on geographic position information obtained by the navigation position source.

2. The vehicle weapon launcher safety system of claim 1, wherein the external interface writes geographic weapon launch boundary definitions to the system memory.

3. The vehicle weapon launcher safety system of claim 2, wherein the memory stores the geographic weapon launch boundary definitions.

4. The vehicle weapon launcher safety system of claim 3, wherein the arm power interrupt controls weapon launcher power.

5. The vehicle weapon launcher safety system of claim 4, wherein the noise filter establishes threshold tolerance distances for geographic position measurements and stores them in the memory.

6. The vehicle weapon launcher safety system of claim 5, wherein the processor continuously compares vehicle position as measured by the navigation position source to the geographic weapon launch boundary definitions stored in the memory and writes instructions to enable the arm power interrupt to supply power to the weapon launcher when the vehicle is within an area defined by the geographic weapon launch boundary definitions and writes instructions to disable the arm power interrupt from supplying power to the weapon launcher when the vehicle is outside an area defined by the launch boundary definitions.

7. The vehicle weapon launcher safety system of claim 6, wherein the processor's enabling and disabling of the weapon launcher power is preempted when the vehicle position relative to the launch boundary definition is within the stored threshold tolerance distance.

8. The vehicle weapon launcher safety system of claim 2, wherein the processor checks the accuracy of the geographic weapon launch boundary definitions based on horizontal and vertical readings received from multiple positional sources.

9. The vehicle weapon launcher safety system of claim 8, wherein the processor disables the arm power interrupt if the geographic weapon launch boundary definitions are not accurate based on horizontal and vertical readings received from the multiple positional sources.

10. The vehicle weapon launcher safety system of claim 1, wherein the system mode controller controls operational states of the vehicle weapon launcher safety system.

11. A method for controlling a vehicle weapon launcher comprising:

writing weapon launch boundary definitions to a vehicle weapon launcher system memory;

storing the weapon launch boundary definitions in the vehicle weapon launcher system memory;

receiving vehicle geographic position coordinates from a vehicle weapon launcher system navigation position source;

continuously comparing the weapon launcher boundary definitions to the vehicle's geographic position coordinates;

enabling power to the vehicle weapon launcher when the vehicle is within the weapon launch boundary; and disabling power to vehicle weapon launcher when the vehicle is outside of the weapon launch boundary.

12. The method of claim 11, further comprising determining accuracy of the boundary definitions based on horizontal and vertical readings received from multiple geographic positional sources.

13. The method of claim 12, further comprising disabling an arm power interrupt if the boundary definitions are not accurate.

14. The method of claim 13 further comprising establishing a geographic threshold tolerance distance.

15. The method of claim 14 further comprising storing the geographic threshold tolerance distance.

16. The method of claim 15, wherein the enabling and disabling of the vehicle weapon launcher is preempted when the vehicle position in relation to the launch boundary definition is within the stored threshold tolerance distance.

* * * * *

UNITED STATES PATENT AND TRADEMARK OFFICE

CERTIFICATE OF CORRECTION

PATENT NO. : 8,843,305 B1
APPLICATION NO. : 13/870488
DATED : September 23, 2014
INVENTOR(S) : Jacob et al.

It is certified that error appears in the above-identified patent and that said Letters Patent is hereby corrected as shown below:

Please add the following inventor to the Title Page in items (71) and (72):

SCOT LYNN
23098 Sweetday Lane
California, Maryland 20619

Signed and Sealed this
Twenty-fourth Day of March, 2015

Michelle K. Lee

Michelle K. Lee
*Director of the United States Patent and Trademark Office*